US008771093B2

(12) United States Patent
Bowen

(10) Patent No.: US 8,771,093 B2
(45) Date of Patent: Jul. 8, 2014

(54) REMOVABLE STAIR SLIDE

(76) Inventor: Spencer Lee Bowen, Highlands Ranch, CO (US)

( * ) Notice: Subject to any disclaimer, the term of this patent is extended or adjusted under 35 U.S.C. 154(b) by 125 days.

(21) Appl. No.: 13/452,555

(22) Filed: Apr. 20, 2012

(65) Prior Publication Data

US 2013/0281221 A1 Oct. 24, 2013

(51) Int. Cl.
*A63G 21/00* (2006.01)
*A63G 31/00* (2006.01)

(52) U.S. Cl.
USPC ..... 472/116

(58) Field of Classification Search
USPC ..... 472/116–117; 104/69–70
See application file for complete search history.

(56) References Cited

U.S. PATENT DOCUMENTS

| | | | | | |
|---|---|---|---|---|---|
| 728,028 | A * | 5/1903 | Chase | 238/41 |
| 2,270,909 | A * | 1/1942 | Spizer | 472/116 |
| 2,839,299 | A * | 6/1958 | Weiss | 472/106 |
| 3,743,281 | A * | 7/1973 | Gimbel | 472/116 |
| 4,813,663 | A * | 3/1989 | Rice | 472/116 |
| 5,246,401 | A * | 9/1993 | Boatwright | 472/116 |
| 6,146,282 | A * | 11/2000 | McCready et al. | 472/117 |
| 7,789,761 | B1 * | 9/2010 | Lumsden | 472/116 |

* cited by examiner

*Primary Examiner* — Kien Nguyen

(57) ABSTRACT

Embodiments of the present disclosure provide for sliding apparatus comprising a slide portion having a first surface, a second surface, a proximal end and a distal end. In certain embodiments, at least one of the first surface or the second surface is configured to be placed over one or more stairs of a staircase, such that at least a portion of the first surface or the second surface is in direct contact with at least a portion of the one or more stairs of the staircase. The sliding apparatus also includes an anchor member coupled to the proximal end of the slide portion. The anchor member is configured to move from a contracted position to an extended position such that when the anchor member is in the extended position the anchor member is secured between a first vertical surface of the staircase and a second vertical surface of the staircase.

19 Claims, 6 Drawing Sheets

REMOVABLE STAIR SLIDE

BACKGROUND

Outdoor slides are typically very popular on playgrounds, play sets, swing sets and other outdoor apparatuses. However, these outdoor slides typically have a number of drawbacks. For example, some slides may be too high for younger children, a slide may only be used when the weather outside is sunny or warm, the slide may be too hot on sunny days, a home owner or occupant may not have enough room in a yard for an outdoor slide or may not live close enough to a park or otherwise have access to a slide. Additionally, some slides may be dangerous to ride at night.

Although relatively specific problems have been discussed, it should be understood that the embodiments disclosed herein should not be limited to solving the specific problems identified in the background.

BRIEF SUMMARY

This summary is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

Embodiments of the present disclosure provide for sliding apparatus comprising a slide portion having a first surface, a second surface, a proximal end and a distal end. In certain embodiments, at least one of the first surface or the second surface is configured to be placed over one or more stairs of a staircase, such that at least a portion of the first surface or the second surface is in direct contact with at least a portion of the one or more stairs of the staircase. The sliding apparatus also includes an anchor member coupled to the proximal end of the slide portion. The anchor member is configured to move from a contracted position to an extended position such that when the anchor member is in the extended position the anchor member is secured between a first vertical surface of the staircase and a second vertical surface of the staircase.

In another embodiment, a slide apparatus is disclosed, the slide apparatus comprising a slide portion having at least one substantially planar surface configured to be placed over one or more stairs of a staircase. The slide apparatus also includes at least one anchor member coupled to a first end of the slide portion and the anchor member is configured to secure the slide portion to a first surface of the staircase and a second surface of the staircase.

Also disclosed herein is a slide apparatus comprising a flexible slide member having a first surface and a second surface. According to one or more embodiments, the first surface of the flexible slide member is substantially planar and the second surface is substantially non-planar. An anchor member is removably coupled to a proximal end of the flexible slide member and is configured to secure the flexible slide member to one or more inner surfaces of a staircase.

BRIEF DESCRIPTION OF THE DRAWINGS

Further features, aspects, and advantages will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various embodiments are described more fully below with reference to the accompanying drawings, which form a part hereof, and which show specific exemplary embodiments. However, embodiments may be implemented in many different forms and should not be construed as limited to the embodiments set forth herein; rather, these embodiments are provided so that this disclosure will be thorough and complete, and will fully convey the scope of the embodiments to those skilled in the art. The following detailed description is, therefore, not to be taken in a limiting sense.

Figure 1:
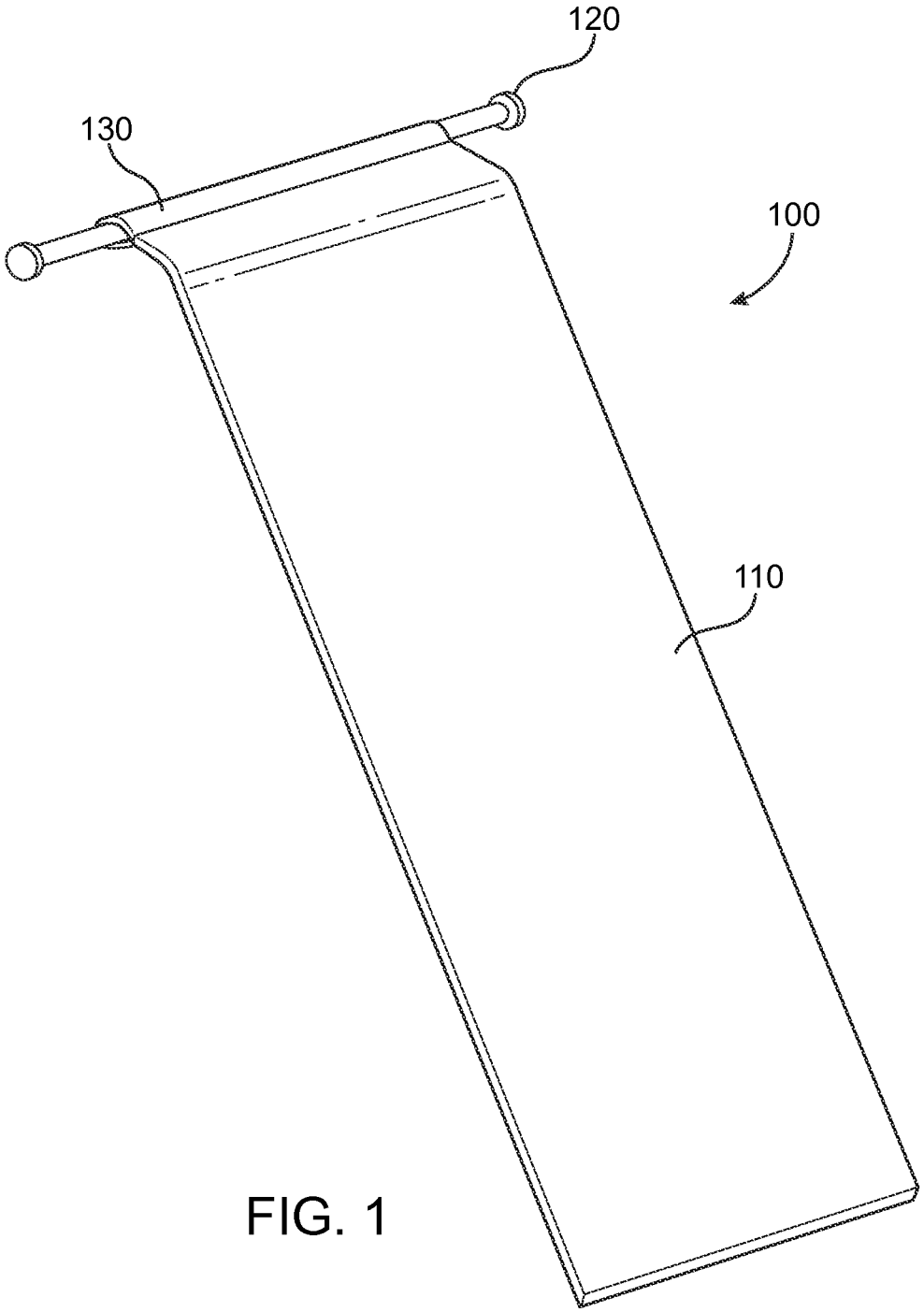
FIG. 1 illustrates a stair slide according to a first embodiment of the present disclosure.

FIG. 1 illustrates a stair slide 100 according to one or more embodiments. As shown in FIG. 1, the stair slide 100 includes a slide portion 110 and an anchor member 120. In certain embodiments, each side of the slide portion 110 (e.g., a top side and a bottom side) may be flat, or substantially flat. The top side may be used by an individual as an actual slide while the bottom side is placed over one or more stairs of a staircase such that at least a portion of the bottom side is in direct contact with at least a portion of one or more stairs of the staircase.

In certain embodiments, the entire slide portion 110 may be made of a single material, such as, for example, cotton, polyester, Minky, nylon, satin, vinyl, pvc, pleather, Kevlar, sheeting or any combination thereof. In another embodiment, the top side of the slide portion 110 may be made of a first material that is conducive to sliding (e.g., pvc or nylon), while the bottom side of the slide portion 110 (or at least a portion thereof) is made from a second material that helps prevent the slide portion from moving when the stair slide 100 is placed on one or more stairs of the staircase. Non-limiting examples of the second material may include a gripping material, rubber, or other such elastomeric material. In another embodiment, the second material may be vinyl, pvc, nylon, Minky, polyester, cotton, denim, twill, canvas, corduroy, duck, pleather, sheeting or any combination thereof. In still yet another embodiment, the slide portion 110, or at least a portion thereof, may be made with, or be coated by a hard or inflexible plastic, a flexible plastic, or other such polymer. For example, the top side of the slide portion 110 may be made from a plastic while the bottom portion made from a material that prevents, or helps prevent, the slide portion 110 from moving.

In one or more embodiments, the slide portion 110 may include a structure component that is enclosed by the one or more materials discussed above. In certain embodiments, the structure component comprises a foam material such as, for example, a solid foam material, a syntactic foam material and the like. In embodiments, the foam material is sufficiently stable so as to maintain its structure (slightly bends or folds) as a child or other individual slides down the slide portion 110.

In another embodiment, the structure component may comprise an inflatable component. The inflatable component may be enclosed by a cover made of the one or more materials discussed above. In another embodiment, the slide portion 110 may be inflatable. In such embodiments, the inflatable portion may enable a user to inflate or deflate the slide portion 110 and/or adjust the rigidity of the slide portion 110. In embodiments where the structure component is inflatable, various portions of the stair slide may inflate to different levels or capacities. For example, the slide portion 110 may inflate to a first size or capacity while the sides may inflate to a second (i.e., greater) size or capacity (e.g., inflatable sides that act as bumpers to keep an individual in the center in the slide 110).

Figure 6:
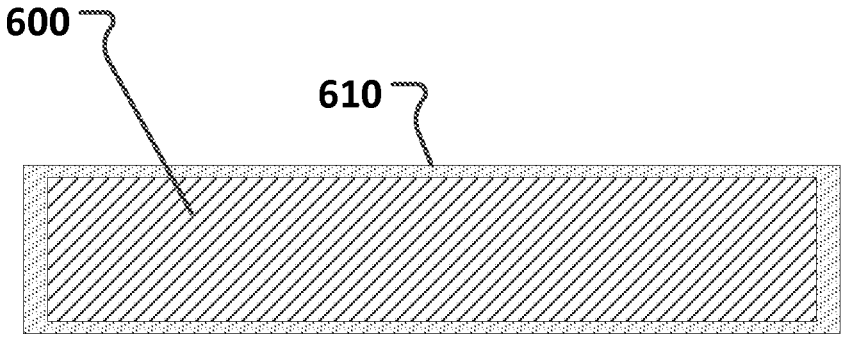
FIG. 6 illustrates cross-sectional view of a stair slide accordion to one or more embodiments of the present disclosure.

In embodiments where a structure component is used, the structure component is enclosed by a cover such as shown in FIG. 6. In certain embodiments, the cover 610 may be removable from the structure component 620. Because the cover 610 is removable, the cover 610 may be washed, replaced, and/or repaired if and when needed. Such a configuration also enables a user to customize the overall look of the stair slide 100 and/or the slide portion 110.

For example, additional covers for a slide portion 110 may be available for purchase and each cover may have a different design, color or logo. For example, a cover may include a logo from a professional sports team (e.g., Seattle Seahawks, Denver, Nuggets, etc.), a College or University, a character or individual from a book, movie, video game etc. (e.g., Batman) or symbol of a particular character (e.g., Batman symbol, Superman symbol) and the like. Although specific examples have been given, the disclosure is not so limited and other customizable features may be added to the stair slide 100.

It is contemplated that one or more accessories may be added to the stair slide 100. These accessories (not shown) may include a tunnel, a landing pad (e.g., attached, either permanently or removably, to a distal end of the stair slide 100), a climbing rope (e.g., attached to the anchor member 120 to assist a user in climbing up the slide portion 110), a ball pit (e.g., attached, either permanently or removably, to a distal end of the stair slide 100), a helmet, a stair slide sled, a sensor or other trigger mechanism that triggers lights, sounds, spray of water, etc., and the like. In certain embodiments, each accessory may be removably attached to a proximal end, a distal end, or another portion of the stair slide 100. For example and as mentioned above, a landing pad may be attached to a distal end of the stair slide 100 using buttons, snaps, Velcro, straps and the like. The landing pad may include a structure component such as was described above or may include pellets or other such material. The landing pad may also have a width greater than that of the slide portion 110. As was also discussed above, in certain embodiments, the accessories may be permanently coupled to the stair slide 100.

Referring back to FIG. 1, stair slide 100 may also include an anchor member 120. In certain embodiments, the anchor member 120 is removably coupled to a proximal end of the slide portion 110 of the stair slide 100. The anchor member may have a pad on each end to protect the staircase in which the anchor member is secured. In such embodiments where the anchor member 120 is removably coupled to the stair slide 100, the slide portion 110 may include a sleeve 130 through which the anchor member 120 is placed. In another embodiment, the anchor member 120 cannot be removed from the sleeve portion 130. In embodiments where a locking mechanism is used, the sleeve 130 may have an opening through which the locking mechanism may be accessed. Although a sleeve portion 130 is specifically mentioned, other embodiments provide that the anchor member 120 may be coupled to the slide portion 110 by other means such as, for example, straps, fasteners, bands and the like.

In one or more embodiments, the anchor member 120 may be configured to move from a contracted position to an extended position and vice versa. The anchor member may move from the contracted position to the extended position (and vice versa) in response to a crank or lever being actuated or in response to a twisting motion, or any combination thereof. As different staircases may have different widths, the anchor member may be extended into a number of different extended positions. In some embodiments, the anchor member 120 may have a locking mechanism (not shown) configured to secure the anchor member 120 in any one of the extended positions. In certain embodiments, the crank or level may be part of the locking mechanism.

As will be described below with respect to FIG. 4, because the anchor member 120 moves from the contracted position to an extended position, a user may be able to secure the stair slide 100 between two or more surfaces of a staircase when the stair slide 100 is in use. When the stair slide is not in use, the user may unlock the locking mechanism (if present), contract the anchor member 120 and remove the stair slide 100 from the staircase. In certain embodiments, the locking mechanism may also be used to lock the locking mechanism in the contracted position.

Figure 2:
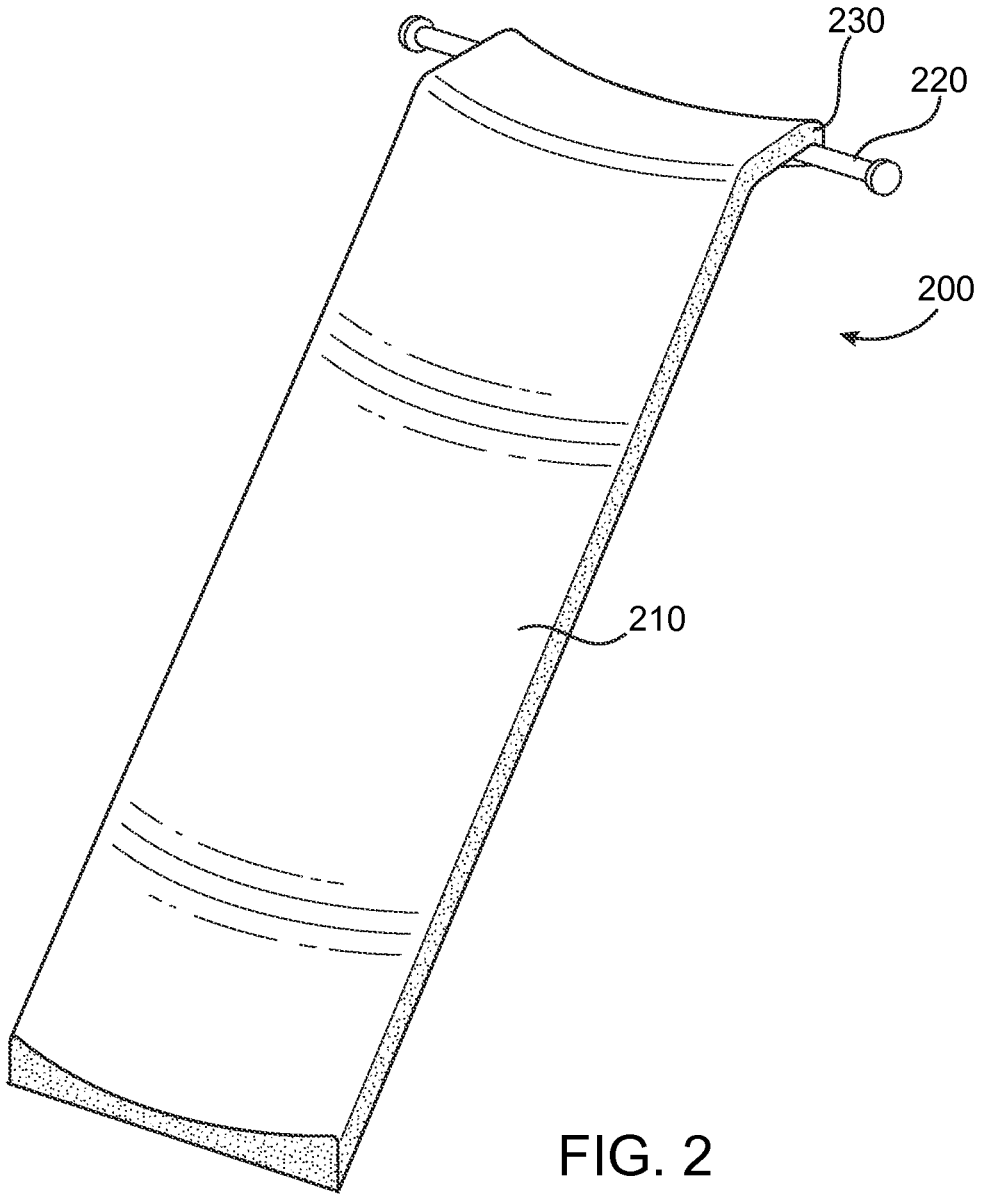
FIG. 2 illustrates a stair slide according to a second embodiment of the present disclosure.

FIG. 2 illustrates a stair slide 200 according to another embodiment of the present disclosure. The stair slide 200 may be comprised similar materials and have a similar construction (e.g., similar structure components) such as was described above with respect to stair slide 100 (FIG. 1). However, in contrast to stair slide 100 (in which the top side is flat or substantially flat), the top side of the slide portion 210 of stair slide 200 is at least partially concave. Although a concave configuration is specifically mentioned, it is contemplated that other shapes or indentations in the top side of the slide portion 210 may be used. For example, the slide portion 210 may be rectangular or circular. Additionally, it is contemplated that all, or a portion, of the slide portion 210 may be totally enclosed so as to form a tunnel.

Stair slide 200 also includes an anchor member 220 and sleeve 230 such as was described above with respect to stair slide 100. In certain embodiments, the anchor member may be coupled to a proximal end of the stair slide 200 via a sleeve 230 and may be configured to move from an extended position in which the stair slide 200 is secured between vertical walls of a staircase and a contracted position in which the stair slide 200 may be removed from the staircase.

It is contemplated that the slide portion 210 of the stair slide 200 may include a structure component comprising a foam, an inflatable portion, a cover, or any combination thereof. Additionally, it is contemplated that one or more accessories may be permanently or removably attached to one or more portions of the stair slide 200.

Figure 3A:
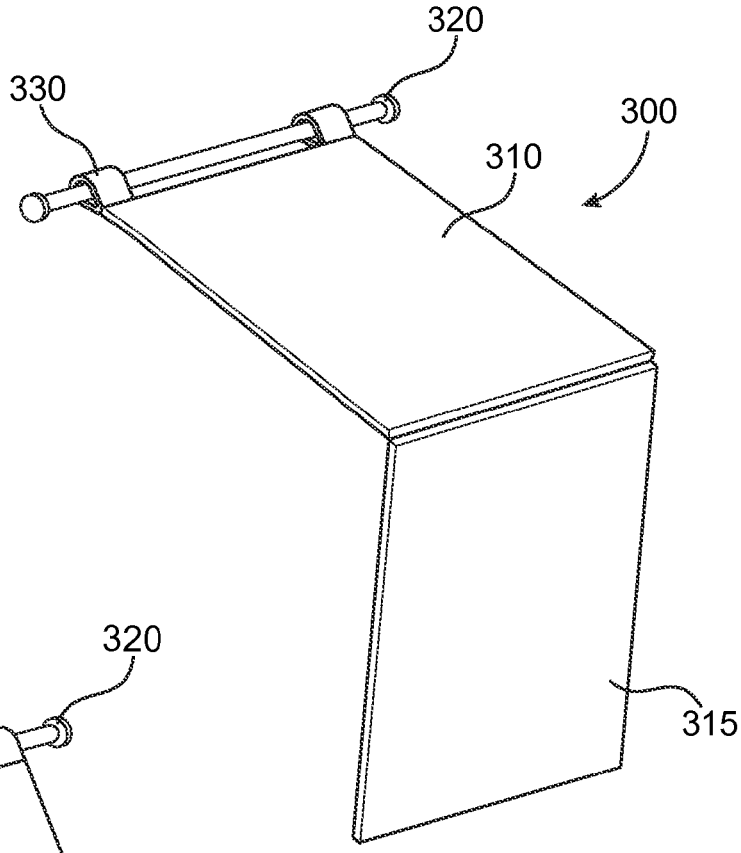
FIGS. 3A-3B illustrate a stair slide according to a third embodiment of the present disclosure.
Figure 3B:
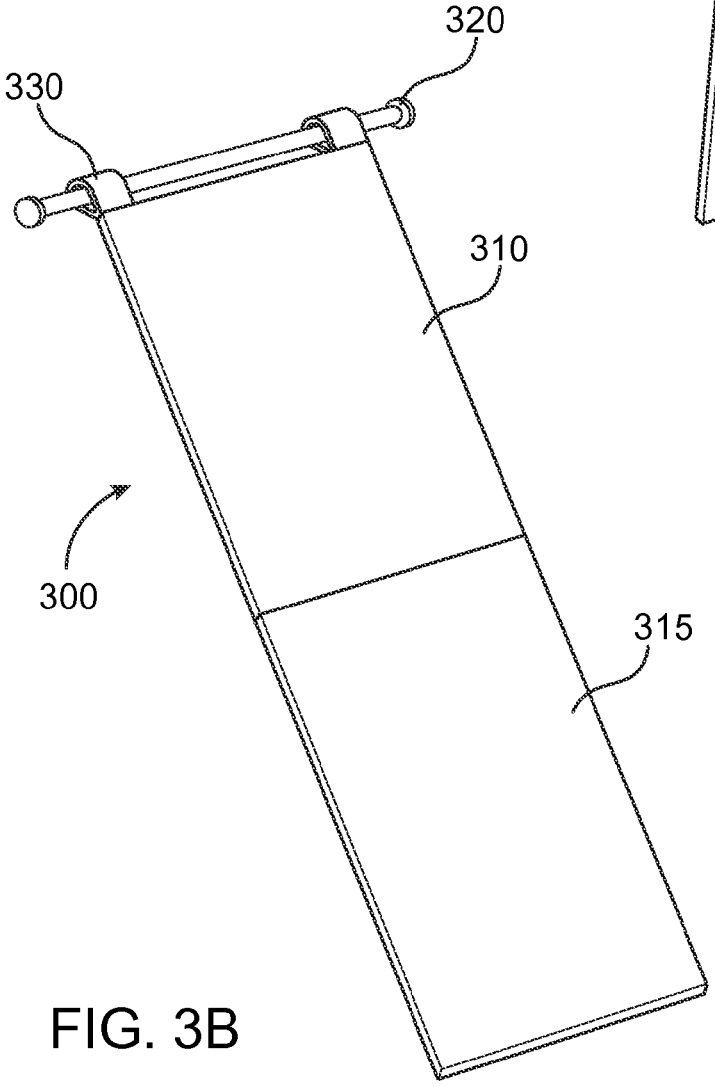

FIGS. 3A-3B illustrate a stair slide 300 according to a third embodiment of the present disclosure. In certain embodiments, the stair slide 300 is foldable and includes an upper slide portion 310 and a lower slide portion 315 coupled to the upper slide portion 310. In certain embodiments, the lower slide portion 315 may be removably attached to the upper slide portion 310.

In an embodiment, the stair slide 300 is foldable to: (i) affect a length of the stair slide 300, and (ii) enable the stair slide 300 to be stored more efficiently. The stair slide 300 also includes an anchor member 320 and one or more sleeves 330 that may be used to couple the anchor member 320 to the upper slide portion 310.

In certain embodiments, the upper slide portion 310 and the lower slide portion 315 may include respective structure components, covers etc. Additionally, one or more accessories may be either removably or permanently coupled to one or more portions of the stair slide 300.

Figure 4:
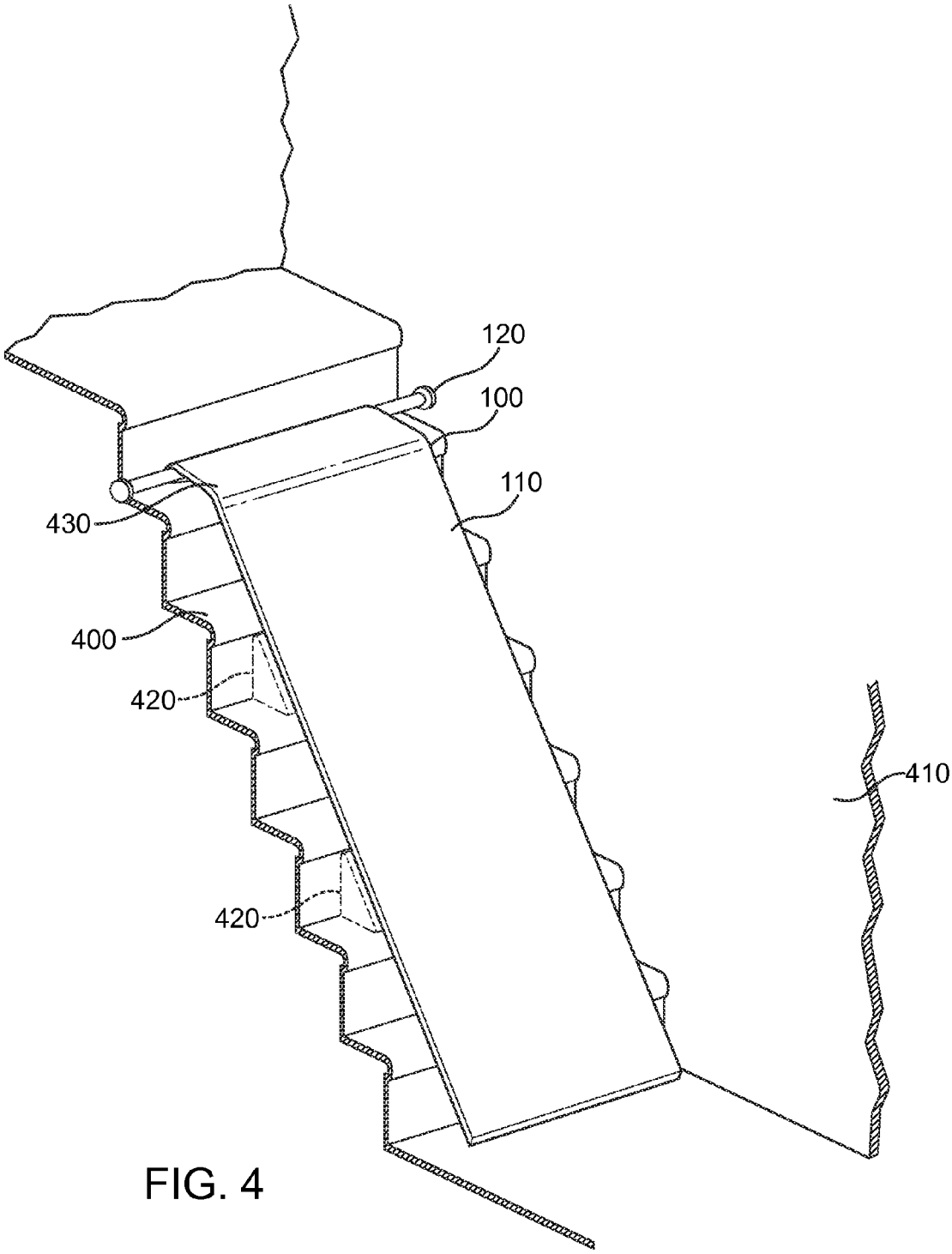
FIG. 4 illustrates the stair slide of FIG. 1 removably connected to a staircase according to one or more embodiments.

FIG. 4 illustrates the stair slide 100 of FIG. 1 removably coupled to one or more surfaces of a staircase 400 according to one or more embodiments. As shown in FIG. 4, the bottom side of the slide portion 110 is placed over one or more stairs of a staircase 400 which leaves the top side of the slide portion 110 accessible to an individual to slide down. As discussed above, the anchor member 120 is coupled to a proximal end of the stair slide 110 and may be configured to move from a contracted position to an extended position in order to secure the stair slide 100 between vertical surfaces of a staircase 400. In embodiments, the vertical surfaces may include a wall 410 of the staircase 400, a molding of the staircase or other such surface.

In certain embodiments, one or more support members 420 may be coupled to the bottom side of the stair slide 100. The support members 420 may be configured as a support wedge that mates with at least a portion of one or more stairs of the staircase 400. In embodiments where the support members 420 are included, the support members may be attached and detached from various areas of the stair slide 100.

Although the stair slide 100 shown in FIG. 4 is shown to cover 6 stairs, it is contemplated that the stair slides of the present disclosure may vary in length. In certain embodiments, the length of the stair slide may be between 2 feet in length and 20 feet in length although other lengths are contemplated. For example, the stair slide may have a first length based on an anticipated age of an individual that will use the stair slide (e.g., 5 feet long for ages 2-5, and 8 feet long for ages 6 and above). Additionally, the slide may have a length based on the number of stairs in a staircase of a particular house. Likewise the width of the slide may vary between 14 inches and 60 inches although other widths are contemplated. For example, the width of the stair slide may be such that when the stair slide is secured in the staircase, at least a portion of the staircase is left uncovered which enables an individual to make use of the stairs in the staircase without stepping on or requiring the removal of the stair slide.

Referring back to FIG. 4, as shown, at least a portion of the stair slide 100 may act as a launch point 430. In certain embodiments, the launch point 430 is at least a portion of the slide portion 110 that is flexible so as to enable the launch point 430 to rest substantially flush or flush against a stair of the staircase 400. A launch point 430 may enable an individual to sit comfortably on the top of the slide portion 110 and begin sliding down the slide portion 110 without coming into contact with the stairs. In certain embodiments, the launch point 430 may be a separate portion from the slide portion 110 and/or be made a material and/or have a structure component that is different from the slide portion 110. For example, if the slide portion 110 is inflatable, the launch point 430 may be made of foam or other material. In yet another embodiment, the launch point 430 (or upper portion of the slide portion 110) may have a width greater than the width of the slide portion 110.

Figure 5:
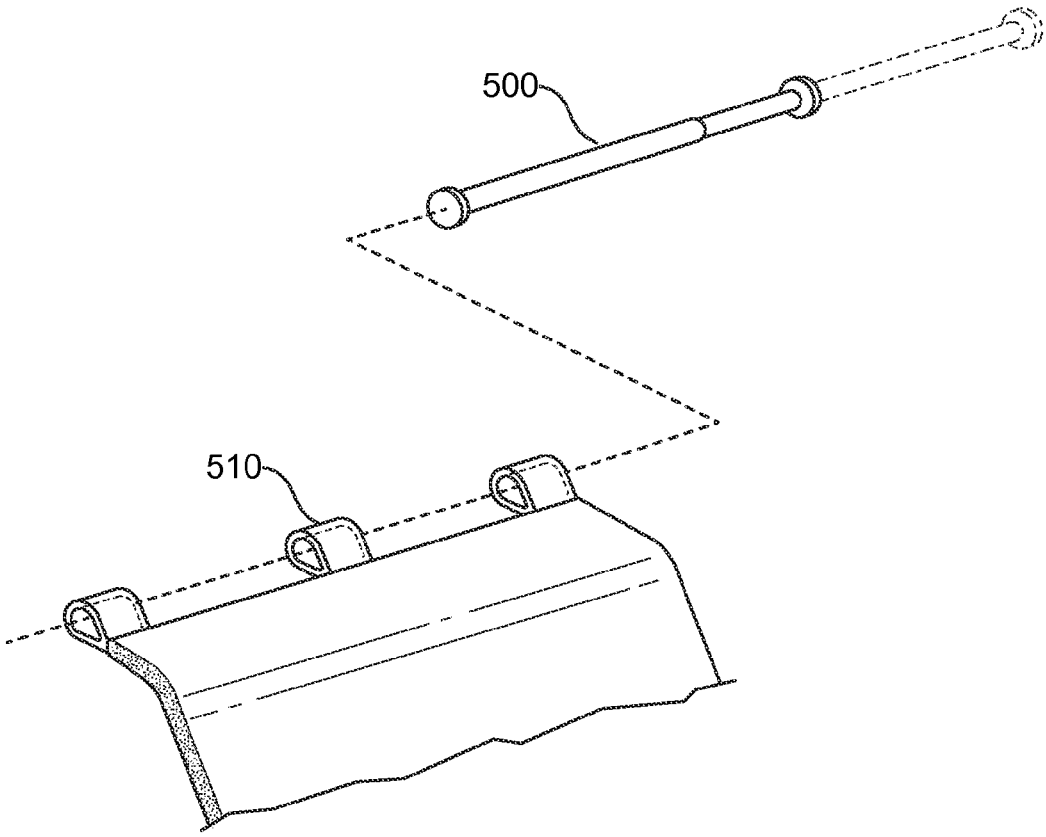
FIG. 5 illustrates an anchor member for a stair slide according to one or more embodiments.

FIG. 5 illustrates an anchor member 500 for a stair slide according to one or more embodiments. As discussed above, the anchor member 500 may move between a contracted position and an extended position. When in the extended position, the anchor member 500 is configured to secure a stair slide to one or more surfaces of a staircase. As also shown in FIG. 5, the anchor member 500 may be coupled to at least a portion of a stair slide via one or more sleeves 510.

Although only one anchor member has been shown and described above, it is contemplated that multiple anchor members may be used on a single stair slide. For example, an anchor member 500 may be placed on both a proximal end and a distal end of a stair slide. Likewise, an anchor member may be placed in a middle portion of a stair slide.

In alternative embodiments, one or more of the stair slides disclose herein may be configured in different shapes. For example, one or more of the stair slides disclosed herein may have a spiral configuration so as to fit on one or more stairs of a spiral staircase. Likewise, the top of the stair slide may have various configurations. For example, the top surface of the stair slide may have one or more waves or bumps.

In other embodiments, the stair slide may extend beyond the top of the stairs or a staircase on which it is placed. In such embodiments, the extension may include a base that supports the slide extension.

Although specific examples, shapes and configurations have been given, one skilled in the relevant art may recognize that the embodiments may be practiced without one or more of the specific details, or with other resources, materials, etc.

The description and illustration of one or more embodiments provided in this application are not intended to limit or restrict the scope of the claims in any way. The embodiments, examples, and details provided in this application are considered sufficient to convey possession and enable others to make and use the best mode of the claimed subject matter. The claimed subject matter should not be construed as being limited to any embodiment, example, or detail provided in this application. Regardless of whether shown and described in combination or separately, the various features are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claims.

What is claimed is:

1. A slide apparatus comprising:

a slide portion having a first surface, a second surface, a proximal end and a distal end, wherein at least one of the first surface or the second surface is configured to be placed over one or more stairs of a staircase, such that at least a portion of the first surface or the second surface is in direct contact with at least a portion of the one or more stairs of the staircase, and wherein the slide portion comprises a structure component at least partially enclosed by a cover; and an anchor member coupled to the proximal end of the slide portion, wherein the anchor member is configured to secure the slide apparatus between a first vertical surface associated with the staircase and a second vertical surface associated with the staircase.

2. The slide apparatus of claim 1, wherein at least a portion of either the first surface or the second surface comprises a gripping material configured to prevent the slide portion from moving when the gripping material comes into contact with the at least the portion of the one or more stairs of the staircase.

3. The slide apparatus of claim 1, wherein the first surface and the second surface are planar.

4. The slide apparatus of claim 1, wherein the first surface is concave and the second surface is planar.

5. The slide apparatus of claim 4, wherein the second surface comprises a gripping material configured to prevent the slide portion from moving when the gripping material comes into contact with the at least the portion of the one or more stairs of the staircase.

6. The slide apparatus of claim 1, wherein the proximal end of the slide portion includes a sleeve configured to receive at least a portion of the anchor member.

7. The slide apparatus of claim 1, wherein the cover is configured to entirely receive the structure component.

8. The slide apparatus of claim 1, wherein the slide portion comprises at least two sub-portions, and wherein a first portion of the at least two sub-portions is pivotally coupled to a second portion of the at least two sub-portions.

9. The slide apparatus of claim 1, wherein a rigidity of the structure component is adjustable.

10. The slide apparatus of claim 1, wherein the structure component comprises a foam component.

11. The slide apparatus of claim 1, wherein the cover is removable from the structure component.

12. The slide apparatus of claim 1, wherein at least a first side the cover comprises a material that is conducive to enable a sliding motion.

13. A slide apparatus comprising:

a slide portion having an inner structure component and an outer component that is different than the inner structure component and wherein the slide portion comprises at least one substantially planar surface configured to be placed over one or more stairs of a staircase; and at least one anchor member coupled to a first end of the slide portion and configured to secure the slide portion to a first surface associated with the staircase and a second surface associated with the staircase.

14. The slide apparatus of claim 13, wherein the slide portion comprises at least one concave surface on a side of the slide portion that is opposite from the at least one substantially planar surface.

15. The slide apparatus of claim 13, further comprising at least a second anchor member coupled to a second end of the slide portion and configured to secure the slide portion to a third surface of the staircase and a fourth surface of the staircase.

16. The slide apparatus of claim 13, further comprising one or more accessories removably coupled to at least a portion of one or more of the slide portion or the at least one anchor member.

17. The slide apparatus of claim 13, further comprising one or more inserts removably coupled to the at least one substantially planar surface, wherein each of the one or more inserts are configured to mate with respective stairs of the one or more stairs of the staircase.

18. The slide apparatus of claim 13, wherein the at least one anchor member is configured to move between an extended position and a retracted position, such that: (i) when the at least one anchor member is in the extended position, the anchor member is secured to the first surface associated with the staircase and the second surface associated with the staircase, and (ii) when the at least one anchor member is in the retracted position, the anchor member is removable from the first surface associated with the staircase and the second surface associated with the staircase.

19. The slide apparatus 13 of claim wherein the anchor member is removably coupled to the first end of the slide portion.

* * * * *